US007578692B2

(12) United States Patent
Kaneda

(10) Patent No.: US 7,578,692 B2
(45) Date of Patent: Aug. 25, 2009

(54) CONNECTOR WITH AN ACTIVATOR WITH HINGED UPPER AND LOWER TABS

(75) Inventor: Morihiro Kaneda, Chiba (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 191 days.

(21) Appl. No.: 11/817,106

(22) PCT Filed: Dec. 28, 2005

(86) PCT No.: PCT/JP2005/024108

§ 371 (c)(1),
(2), (4) Date: Aug. 24, 2007

(87) PCT Pub. No.: WO2006/092904

PCT Pub. Date: Sep. 8, 2006

(65) Prior Publication Data

US 2009/0042424 A1 Feb. 12, 2009

(30) Foreign Application Priority Data

Feb. 28, 2005 (JP) ..... 2005-053567

(51) Int. Cl.
*H01R 13/62* (2006.01)
*H01R 13/627* (2006.01)

(52) U.S. Cl. ..... 439/352; 439/159

(58) Field of Classification Search ..... 439/159, 439/352, 353, 357, 378, 344; 385/56, 60, 385/77, 78

See application file for complete search history.

(56) References Cited

U.S. PATENT DOCUMENTS

| | | | | |
|---|---|---|---|---|
| 5,613,869 | A * | 3/1997 | Erlich et al. | 439/344 |
| 6,024,498 | A * | 2/2000 | Carlisle et al. | 385/56 |
| 6,196,733 | B1 * | 3/2001 | Wild | 385/86 |
| 6,254,418 | B1 | 7/2001 | Tharp et al. | |
| 6,287,018 | B1 * | 9/2001 | Andrews et al. | 385/60 |
| 6,318,903 | B1 * | 11/2001 | Andrews et al. | 385/77 |
| 6,322,386 | B1 | 11/2001 | Tharp et al. | |
| 6,454,577 | B1 * | 9/2002 | Yi | 439/108 |
| 6,692,289 | B2 * | 2/2004 | Nemoto | 439/352 |
| 6,799,898 | B2 * | 10/2004 | Cheng et al. | 385/56 |

FOREIGN PATENT DOCUMENTS

| | | |
|---|---|---|
| JP | 63-150872 A | 6/1988 |
| JP | 09-199246 | 7/1997 |
| JP | 2002-305061 | 10/2002 |

* cited by examiner

*Primary Examiner*—Chandrika Prasad
(74) *Attorney, Agent, or Firm*—Barley Snyder LLC

(57) ABSTRACT

A connector boot for a connector having a connector housing with a cantilevered lock tab protruding rearward from an upper surface of the connector housing, comprising a boot main body connected to a rear side of the connector housing, the boot main body comprising an activator that is pivotal about a hinge, wherein the activator comprises an upper activator tab for engaging the lock tab from above and the upper activator tab being configured for a push-down operation, and wherein the activator comprises a rear activator tab located opposite the upper activator tab so that the hinge is between the upper activator tab and the rear activator tab and the rear activator tab being configured for a push-up operation is disclosed.

20 Claims, 9 Drawing Sheets

PRIOR ART

CONNECTOR WITH AN ACTIVATOR WITH HINGED UPPER AND LOWER TABS

CROSS-REFERENCE TO RELATED APPLICATION DATA

This application claims the benefit of the earlier filed parent international application number PCT/JP2005/024108 having an international filing date of Dec. 28, 2005 that claims the benefit of JP2005-053567 having a filing date of Feb. 28, 2005.

FIELD OF THE INVENTION

The present invention relates to a connector boot and a connector assembly that are used to connect a cable for a telephone, LAN, or the like.

BACKGROUND

In cases where a cable for a telephone or LAN is connected, a modular plug such as RJ11 (for telephone use) and RJ45 (for LAN use) is generally employed. Such a modular plug is designed to be connected to a modular jack installed in a LAN port, patch panel, rosette, or the like of a network device such as a telephone or HUB.

For example, the modular plug and modular jack described in JP-A-2002-305061 are known as a conventional modular plug and modular jack. As is shown in FIGS. 11 and 12, the modular plug 101 is connected to the front end portion (left end portion in FIG. 11) of a plug cable 113 such as a LAN cable, and comprises a substantially rectangular plug main body 110 and a plurality of plug contacts 120 attached in a single row to the plug main body 110. Furthermore, a plurality of guide grooves 111 that are formed so that the respective plug contacts 120 are exposed are formed in the undersurface of the plug main body 110. Moreover, a cantilevered lock arm 112 that extends rearward at an inclination toward the top from the front-end corner portion of the plug main body 110 is formed so as to protrude from the upper surface of the plug main body 110. In addition, the plug conductors 114 of the plug cable 113 are connected to the respective plug contacts 120.

Furthermore, as is shown in FIGS. 13 and 14, the modular jack 201 comprises a substantially rectangular jack housing 210 that has on the inside a jack recess 211 for mating with the modular plug 101, and a plurality of jack contacts 220 attached in a single row to the jack housing 210. The respective jack contacts 220 are disposed so as to extend rearward at an inclination toward the top from the front end (right end in FIG. 13) of the bottom portion of the jack recess 211, and the rear end portions of the jack contacts 220 are connected to the jack conductors 231 of a jack cable 230.

Moreover, as is shown in FIG. 15, when the modular plug 101 is inserted into the jack recess 211 of the modular jack 201, the lock arm 112 of the modular plug 101 is locked with a locking part 212 provided on the jack recess 211, so that the modular plug 101 and modular jack 201 are locked together. In this case, the jack contacts 220 provided on the modular jack 201 are guided by the guide grooves 111 of the modular plug 101, and make contact with the plug contacts 120 of the modular plug 101, so that the plug cable 113 and jack cable 230 are electrically connected to each other, allowing the mutual exchange of data. In addition, when the mating between the modular plug 101 and modular jack 201 is to be released, the locked state of the lock arm 112 with the locking part 212 may be released by pushing the portion of the lock arm 112 of the modular plug 101 that protrudes from the jack housing 210 of the modular jack 201 downward with a finger, so that the modular plug 101 can simply be pulled out of the jack recess 211 of the modular jack 201.

However, the following problems have been encountered in the conventional modular plug 101 shown in FIGS. 11 and 12.

Specifically, when the mating between the modular plug 101 and modular jack 201 is to be released, there are cases in which the operation of the lock arm 112 by the finger is difficult. Due to a trend toward high-density mounting of the modular jack 201, in particular, there are cases in which the finger cannot reach the lock arm 112 because of the presence of the plug cable 113 attached to the modular plug 101 that mates with the modular jack 201, and in such cases, the operation of the lock arm 112 by the finger is impossible.

SUMMARY

The present invention was devised in light of the problems described above and it is an object of the present invention to provide a connector boot and a connector assembly that make it possible to perform the release operation of the lock tab easily and reliably when the mating between the connector and mating connector is released.

The present invention relates to a connector boot for a connector having a connector housing with a cantilevered lock tab protruding rearward from an upper surface of the connector housing, comprising a boot main body connected to a rear side of the connector housing, the boot main body comprising an activator that is pivotal about a hinge, wherein the activator comprises an upper activator tab for engaging the lock tab from above and the upper activator tab being configured for a push-down operation, and wherein the activator comprises a rear activator tab located opposite the upper activator tab so that the hinge is between the upper activator tab and the rear activator tab and the rear activator tab being configured for a push-up operation.

BRIEF DESCRIPTION OF THE DRAWINGS

The invention will now be described in greater detail, by way of illustration only, with reference to the accompanying drawings, in which.

DETAILED DESCRIPTION OF THE EMBODIMENTS

Next, an embodiment of the present invention will be described with reference to the figures. In FIGS. 1 through 3, 4A and 4B, and 5A through 5C, the connector boot 1 is designed to be disposed on the rear side of a connector 50 that is connected to the front end portion (right end portion in FIG. 5C) of a cable C such as a LAN cable or telephone cable. The connector boot 1 and connector 50 make up the connector assembly of the present invention. In the present embodiment, the connector 50 is a modular plug, and is designed to mate with a modular jack constituting a mating connector.

Figure 5A:
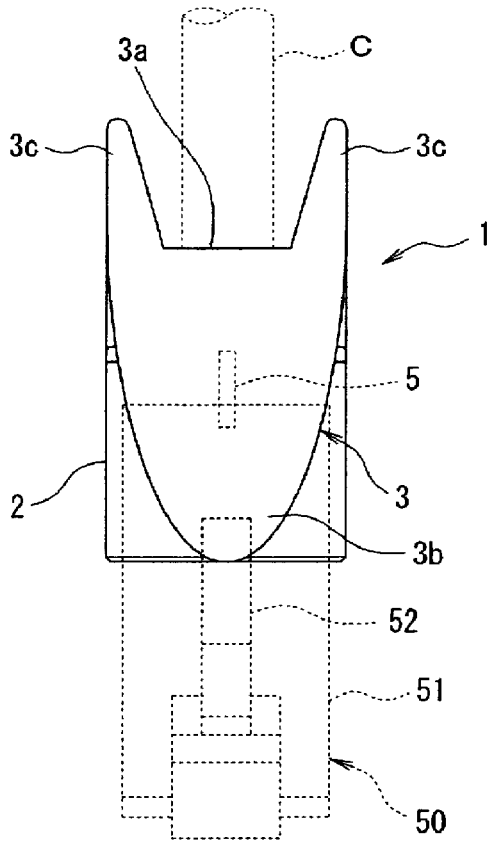
FIGS. 5A through 5C show the connector boot of FIG. 1, with FIG. 5A being a plan view, FIG. 5B being a bottom view, and FIG. 5C being a left side view; the connector and cable are also shown by broken lines.
Figure 5B:
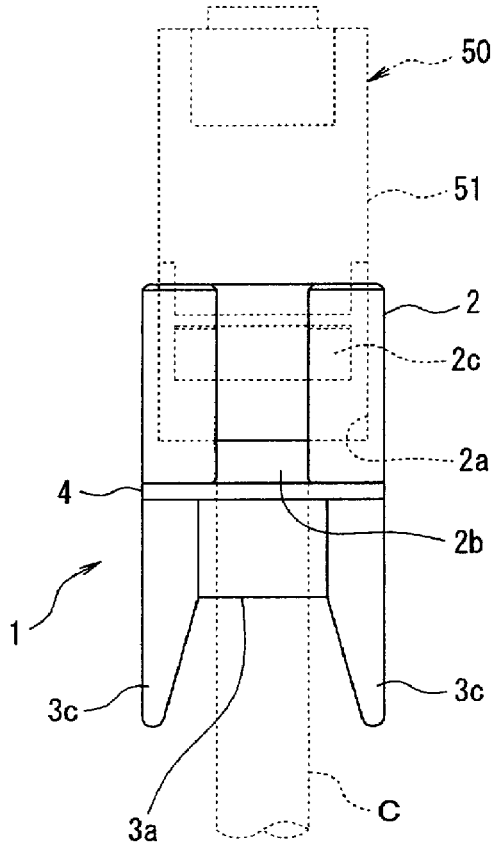
Figure 5C:
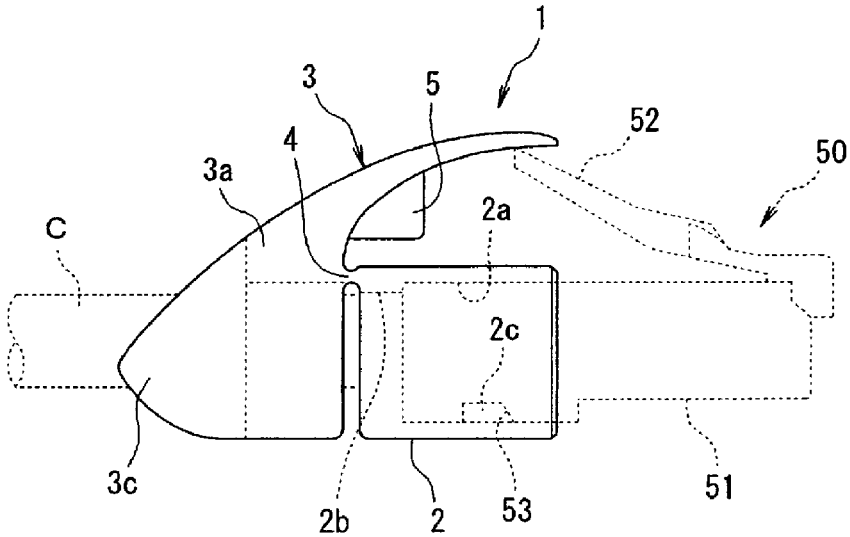
Figure 13:
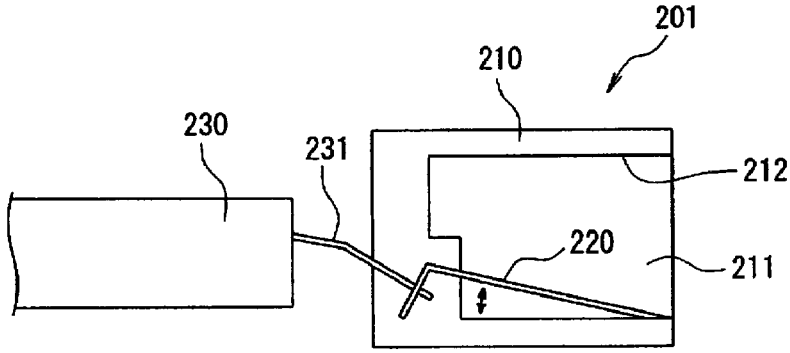
FIG. 13 PRIOR ART
FIG. 13 is a schematic sectional left side view of the modular jack described in the prior art.
Figure 14:
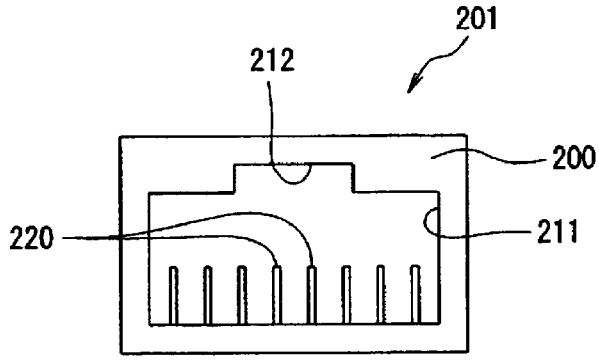
FIG. 14 PRIOR ART
FIG. 14 is a front view of the modular jack of FIG. 13.
Figure 15:
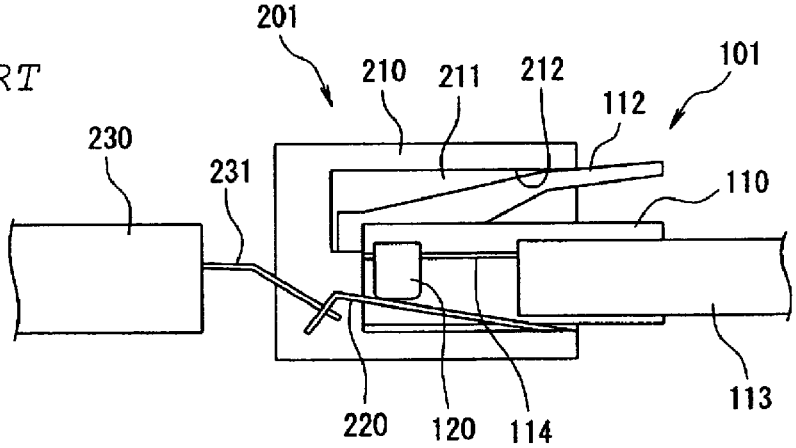
FIG. 15 PRIOR ART
FIG. 15 is a schematic sectional side view showing a state of connection between the modular plug of FIG. 11 and the modular jack of FIG. 13.

Here, the connector 50 comprises a substantially rectangular connector housing 51 connected to the front end portion of the cable C, and a plurality of contacts (not shown in the figures) attached in a single row to the housing along the direction of width (direction perpendicular to the plane of page in FIG. 5C). The connector housing 51 is formed by molding an insulating resin, and a plurality of guide grooves (not shown in the figures) that are formed so as to expose the respective contacts are formed in the undersurface of the connector housing 51. Furthermore, the connector housing 51 is provided with a cantilevered lock tab 52 that extends rearward at an inclination toward the top from the upper surface of the front portion of the connector housing 51. When the connector (modular plug) 50 mates with a mating connector recess of a mating connector (modular jack; not shown in the figures) similar to the modular jack 201 shown in FIGS. 13 through 15, this lock tab 52 is locked with a locking part formed on the mating connector recess, thus locking the connector 50 and mating connector. Moreover, a connector recess 53 is formed in the undersurface of the rear portion of the connector housing 51. Furthermore, the contacts provided on the connector 50 are connected to the conductors (not shown in the figures) of the cable C.

In addition, the connector boot 1 has a boot main body 2 which is attached in a detachable manner to the rear portion of the connector housing 51 that is connected to the front end portion of the cable C. The connector boot 1 is formed by molding an electrically insulating resin (e.g., polycarbonate). Here, the boot main body 2 is formed in a substantially rectangular shape having a boot recess 2*a* that receives the rear portion of the connector housing 51. Furthermore, a pair of left and right locking projections 2*c* are provided on the bottom portion of the boot recess 2*a*. The locking projections 2*c* are locked with the connector recess 53 formed in the connector housing 51 when the rear portion of the connector housing 51 is received, so that the boot main body 2 is attached to the connector housing 51. Moreover, a cable passageway 2*b* that is formed so as to correspond to the external shape of the cable C connected to the connector 50 is formed in the rear end portion of the boot recess 2*a*.

Furthermore, the connector boot 1 has an activator 3 that is provided so as to be pivotable about a hinge (or fulcrum) 4 provided on the rear-end upper corner portion of the boot main body 2. The hinge 4 extends with the same width as the boot main body 2 in the direction of width of the boot main body 2 in the rear-end upper corner portion of the boot main body 2. Moreover, the activator 3 comprises an activator base 3*a* that extends in the direction of width in a pivotable manner about the hinge 4, an upper activator tab 3*b* that extends forward at an inclination toward the top from the activator base 3*a*, that engages with the lock tab 52 of the connector 50 from above in a free state, and that is capable of a push-down operation, and a pair of rear activator tabs 3*c* that extend rearward from either end in the direction of width of the activator base 3*a* so as to be positioned on the opposite side of the hinge 4 from the upper activator tab 3*b* and that are capable of a push-up operation. The upper activator tab 3*b* has the same width as the boot main body 2 at the root portion thereof, and the width becomes gradually smaller toward the tip end. In addition, a stopper 5 that contacts the upper surface of the boot main body 2 is formed so as to protrude from the center in the direction of width of the undersurface of the upper activator tab 3*b*.

Figure 6:
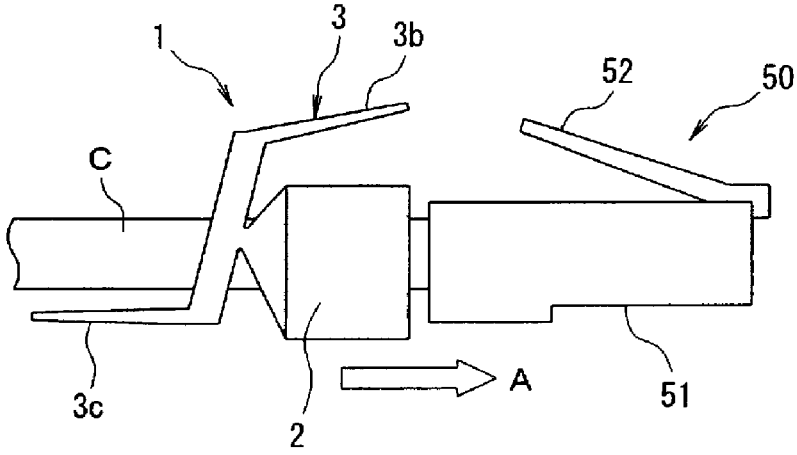
FIG. 6 is a model diagram for illustrating a method for attaching the connector boot shown in FIG. 1 to the connector.

As is shown in FIG. 6, the connector boot 1 is attached to the rear portion of the connector housing 51 of the connector 50 by moving this connector boot 1 in the direction of arrow A from the rear side of the connector 50 in a state in which the connector 50 is attached to the front end portion of the cable C. At this point, the locking projections 2*c* are locked with the connector recess 53 formed in the connector housing 51 although the locking projections 2*c* and connector recess 53 are not shown in FIG. 6. Then, when the attachment of the connector boot 1 is completed, the undersurface on the tip end side of the upper activator tab 3*b* of the connector boot 1 engages with the tip end of the lock tab 52 of the connector 50 from above as shown in FIGS. 1 through 3 and 5A through 5C.

Furthermore, when the connector 50 to which the connector boot 1 is attached is inserted into the mating connector recess of the mating connector, the lock tab 52 of the connector 50 is locked with the locking part provided on the mating connector recess, so that the connector 50 and mating connector are locked together. Then, the cable C connected to the connector 50 and the cable (not shown in the figures) connected to the mating connector are electrically connected, so that the mutual exchange of data becomes possible. When the mating of the connector 50 with the interior of the mating connector recess of the mating connector is completed, the lock tab 52 of the connector 50 is in a state in which the lock tab 52 protrudes slightly rearward from the end surface of the mating connector.

Figure 10:
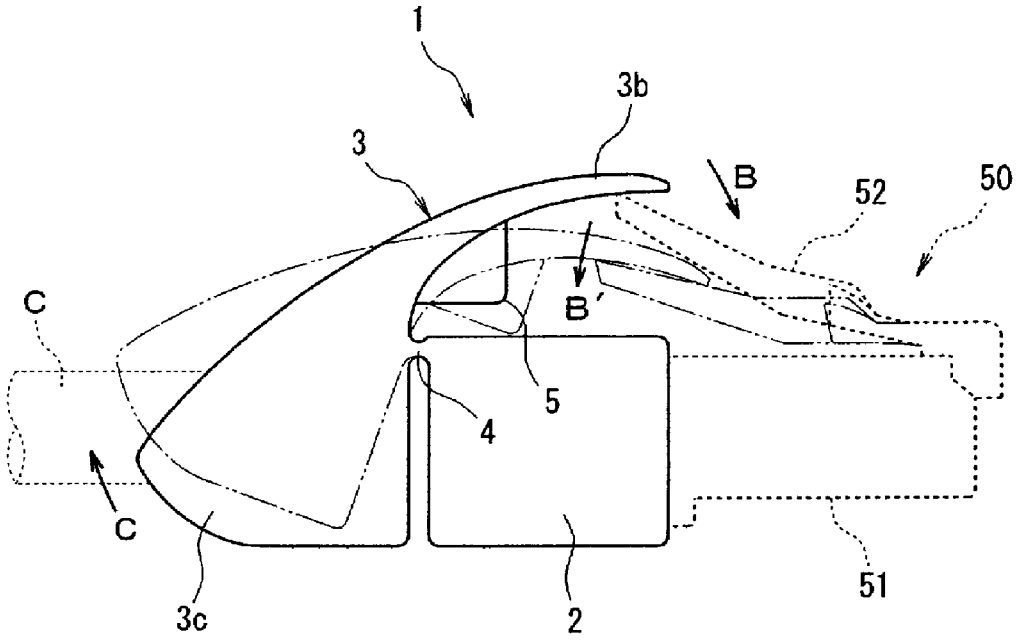
FIG. 10 is an explanatory diagram for illustrating the action of the operating tab of the connector boot.
Figure 11:
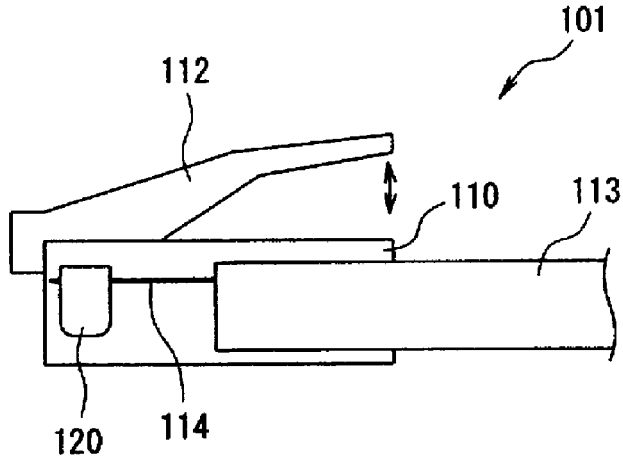
FIG. 11 is a schematic sectional right side view of the modular plug of the prior art.
Figure 12:
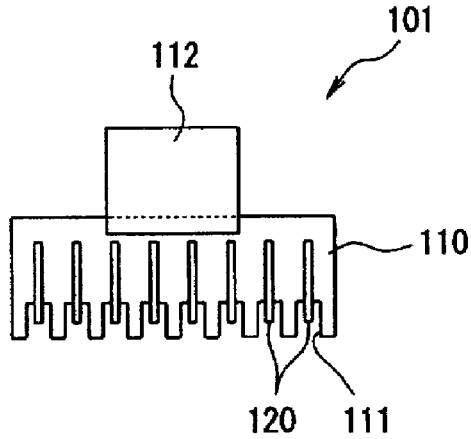
PRIOR ART FIG. 12
FIG. 12 is a front view of the modular plug of FIG. 11.

Moreover, when the mating between the connector 50 and mating connector is to be released, the activator 3 is caused to pivot about the hinge 4 by the push-down operation of the upper activator tab 3*b* of the activator 3 of the connector boot 1 in the direction of solid arrow B or by the push-up operation of the rear activator tabs 3*c* in the direction of solid arrow C as shown in FIG. 10. As a result, the lock tab 52 of the connector 50 is pushed down in the direction of arrow B', and the locked state of the lock tab 52 is released, so that the connector 50 can be pulled out of the mating connector together with the connector boot 1. Consequently, the mating between the connector 50 and mating connector is released. Therefore, the release operation of the lock tab 52 becomes possible not only by operation by means of the upper activator tab 3*b* on the side where the lock tab 52 is located, but also by operating the rear activator tabs 3*c* on the side opposite from the side where the lock tab 52 is located, so that the release operation of the lock tab 52 can be accomplished easily and reliably. Accordingly, in cases where the mating connector is a modular jack and the connector is a modular plug, it is possible to eliminate the problem of the finger not reaching the lock tab because of the presence of the cable attached to the modular plug that mates with the modular jack, which is caused by the high-density mounting of the modular jack. Furthermore, in the push-down operation of the upper activator tab 3*b* of the activator 3 and the push-up operation of the rear activation tabs 3*c*, the upper activator tab 3*b* can be pushed down until the stopper 5 provided on the undersurface of the upper activator tab 3*b* contacts the upper surface of the boot main body 2, and excessive deformation of the activator 3 is prevented as a result of the stopper 5 contacting the upper surface of the boot main body 2.

Moreover, because the operating position of the rear activation tabs 3*c* of the activator 3 can be separated from the mating position with the mating connector, the degree of freedom in operability can be increased. Specifically, because the cantilevered lock tab 52 and the parts to be operated can be separated, the degree of freedom is increased.

In addition, because the upper activator tab 3*b* of the activator 3 is designed to engage with the lock tab 52 from above, the lock tab 52 can be covered by the upper activator tab 3*b*, so that it is possible to avoid the problem of damage caused by bending the lock tab 52 upward by a considerable amount during the mating and mating release of the connector 50 and during storage of the cable.

Furthermore, because the boot main body 2 of the connector boot 1 can be attached to the connector housing 51 of the connector 50 in a detachable manner, the connector boot 1 can be attached to the connector 50 even after the connector 50 is attached to the cable C. Moreover, it is possible to replace only the connector boot 1 in cases where the connector boot 1 is damaged.

An embodiment of the present invention has been described above. However, the present invention is not limited to this embodiment, and various alterations and modifications can be made.

For example, the connector 50 can be applied not only to a modular plug attached to the end portion of the cable C but also to a different connector.

Figure 7:
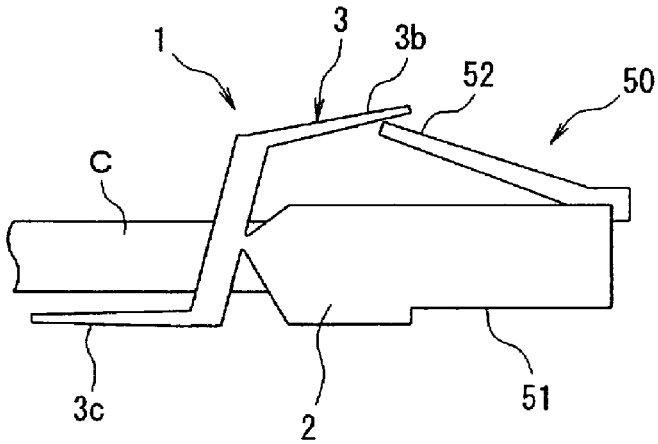
FIG. 7 is a model diagram of a modified example of a connector assembly in which the connector boot is formed integrally with the connector.

Furthermore, as is shown in FIG. 7, the connector boot 1 may also be formed integrally with the connector 50 in a connector assembly. By doing so, the trouble of attaching the connector boot 1 to the connector 50 can be eliminated. Where connector boot 1 and connector 50 are formed integrally, they will not inadvertently become separated.

Figure 1:
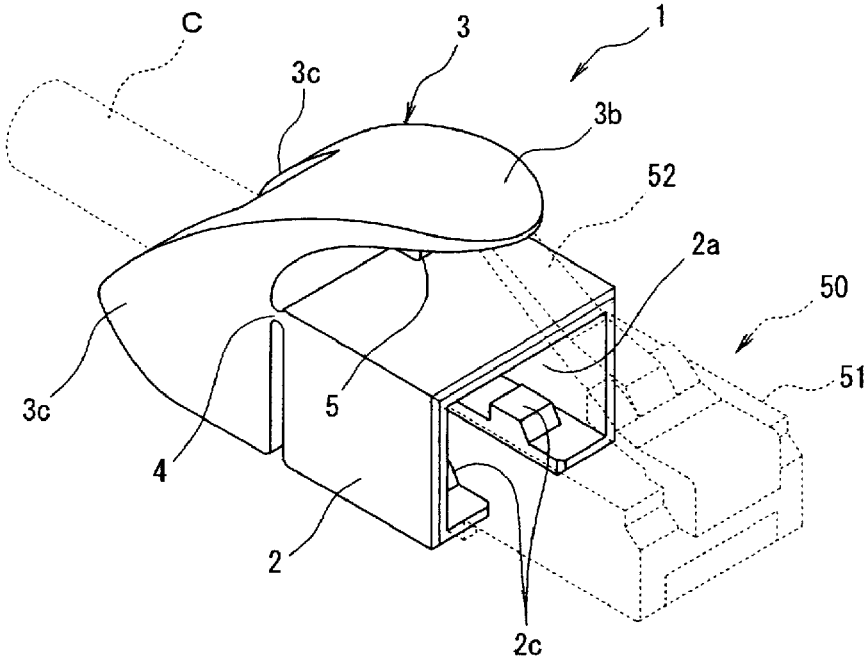
FIG. 1 is a perspective view an embodiment of the connector boot of the present invention as seen from the front at an inclination from above; the connector and cable are also shown by broken lines.
Figure 2:
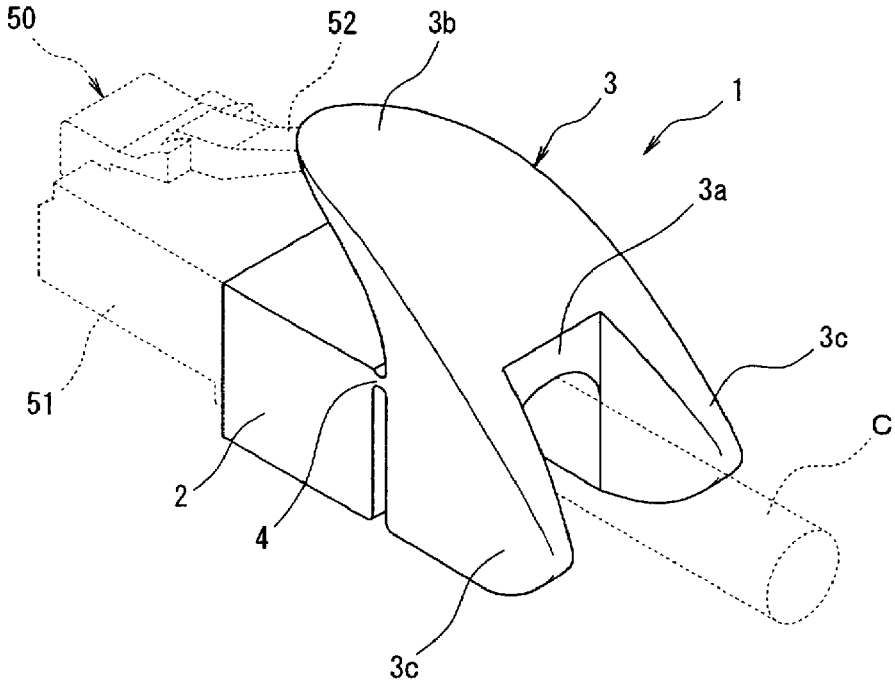
FIG. 2 is a perspective view of the connector boot shown in FIG. 1 as seen from the rear at an inclination from above; the connector and cable are also shown by broken lines.
Figure 3:
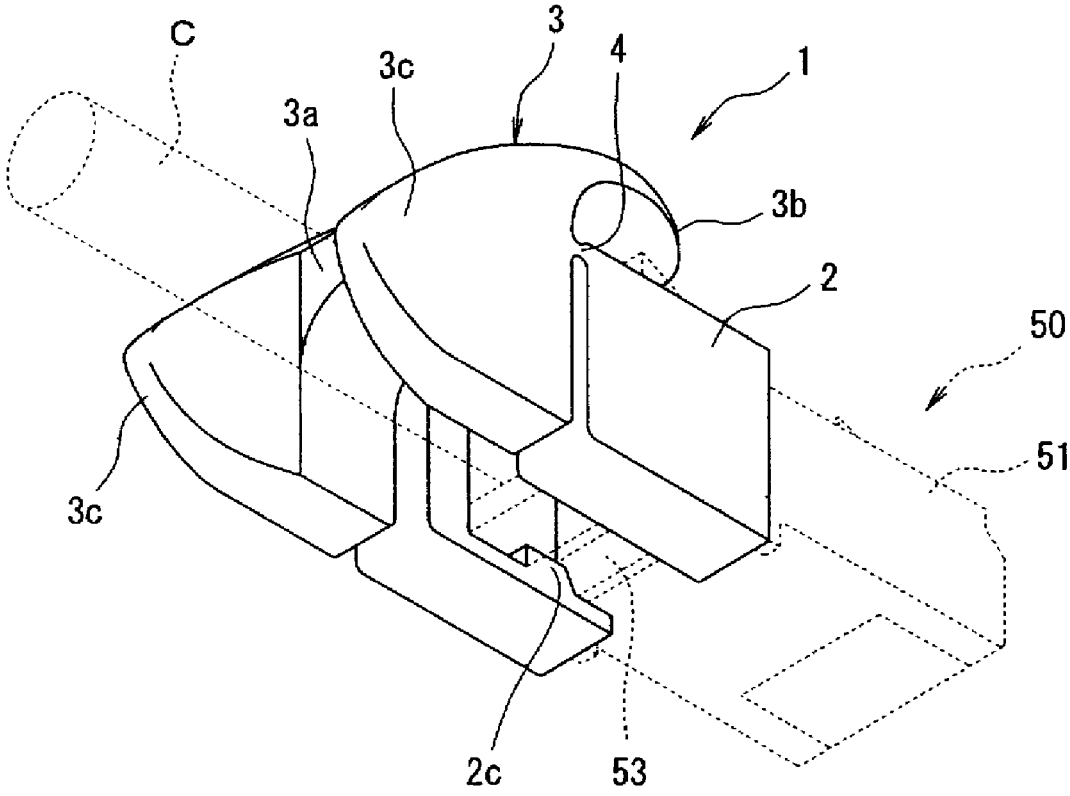
FIG. 3 is a perspective view of the connector boot shown in FIG. 1 as seen from the rear at an inclination from below; the connector and cable are also shown by broken lines.
Figure 4A:
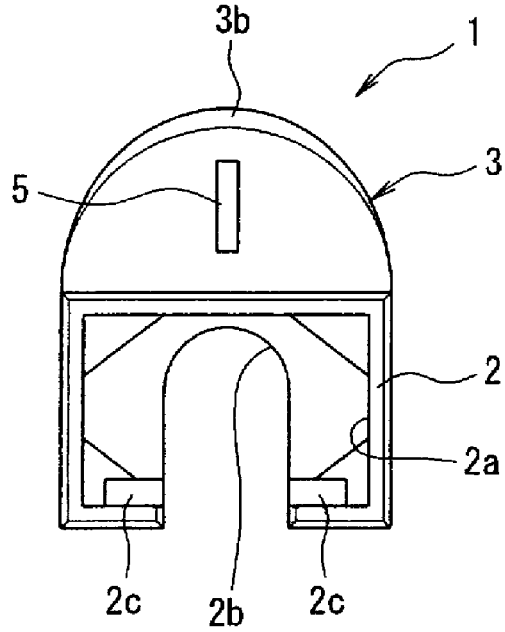
FIGS. 4A and 4B show the connector boot of FIG. 1, with FIG. 4A being a front view, and FIG. 4B being a back view.
Figure 4B:
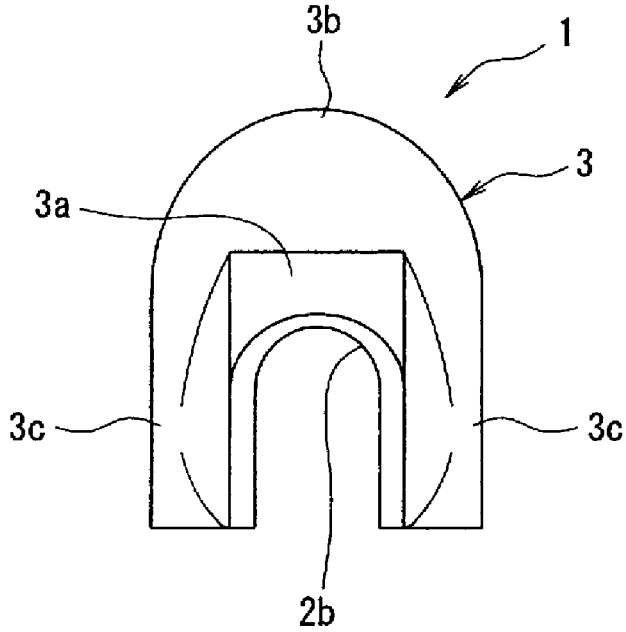
Figure 8:
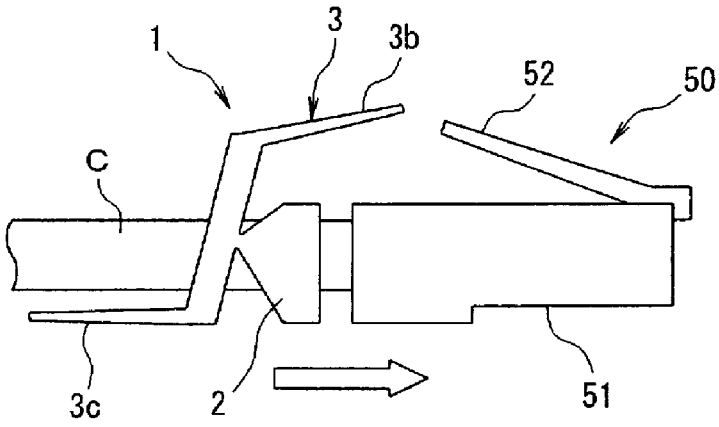
FIG. 8 is a model diagram of another embodiment of a connector boot.

Moreover, as is shown in FIG. 8, it would also be possible to form the shape of the boot main body 2 of the connector boot 1 in a shape different from that of the boot main body 2 of the connector boot 1 shown in FIG. 1, and to attach this boot main body 2 having a different shape to the rear portion of the connector housing 51 of the connector 50.

Figure 9:
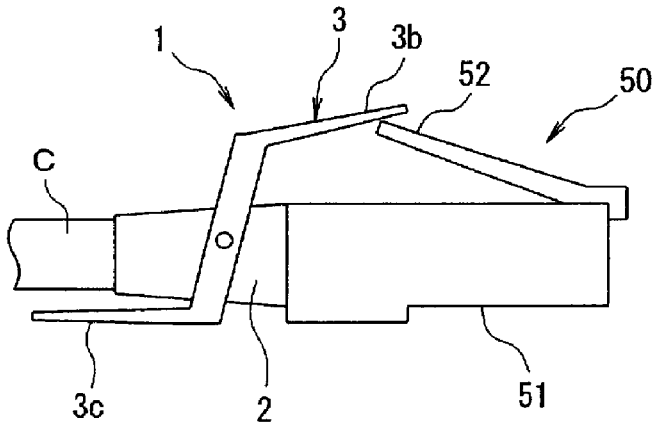
FIG. 9 is a model diagram of another embodiment of a connector boot.

In addition, as is shown in FIG. 9, it would also be possible to connect the connector 50 to the front end portion of the cable C, to dispose an already existing and separate connector boot 1 on the rear side of the connector 50, and then to provide an activator 3 to the boot main body 2 of this connector boot 1 in a detachable manner. Furthermore, in the connector boot 1 shown in FIG. 1, the activator 3 may also be provided to the boot main body 2 in a detachable manner, allowing application of the connector boot 1 to a connector 50 only when a connector boot 1 is needed.

The invention claimed is:

1. A connector boot for a connector having a connector housing with a cantilevered lock tab protruding rearward from an upper surface of the connector housing, comprising:

a boot main body connected to a rear side of the connector housing, the boot main body comprising an activator that is pivotal about a hinge;

wherein the activator comprises an upper activator tab for engaging the lock tab from above and the upper activator tab being configured for a push-down operation; and wherein the activator comprises a rear activator tab located opposite the upper activator tab so that the hinge is between the upper activator tab and the rear activator tab and the rear activator tab being configured for a push-up operation.

2. The connector boot according to claim 1, further comprising a stopper on the upper activator tab for contacting the upper surface of the boot main body.

3. The connector boot according to claim 1, wherein the boot main body is detachably connected to the connector housing.

4. The connector boot according to claim 1, wherein the activator is detachably connected to the boot main body.

5. The connector boot according to claim 1, wherein the hinge extends substantially the same width as the boot main body in a direction of width of the boot main body.

6. The connector boot according to claim 1, wherein the push-down operation causes a movement of the lock tab toward the upper surface of the connector housing.

7. The connector boot according to claim 1, wherein the push-up operation causes a movement of the lock tab toward the upper surface of the connector housing.

8. The connector boot according to claim 1, further comprising:

a cable passageway for receiving a cable connected to the connector.

9. The connector boot according to claim 1, wherein the boot main body comprises a locking projection for locking with a connector recess formed in the connector housing.

10. The connector boot according to claim 1, wherein the boot main body comprises a pair of rear activator tabs located on substantially opposite sides of a cable connected to the connector.

11. A connector assembly, comprising:

a connector comprising a connector housing with a cantilevered lock tab protruding rearward from an upper surface of the connector housing;

a connector boot comprising a boot main body connected to a rear side of the connector housing, the boot main body comprising an activator that is pivotal about a hinge;

wherein the activator comprises an upper activator tab for engaging the lock tab from above and the upper activator tab being configured for a push-down operation; and wherein the activator comprises a rear activator tab located opposite the upper activator tab so that the hinge is between the upper activator tab and the rear activator tab and the rear activator tab being configured for a push-up operation.

12. The connector boot according to claim 11, further comprising a stopper on the upper activator tab for contacting the upper surface of the boot main body.

13. The connector boot according to claim 11, wherein the boot main body is detachably connected to the connector housing.

14. The connector boot according to claim 11, wherein the activator is detachably connected to the boot main body.

15. The connector boot according to claim 11, wherein the hinge extends substantially the same width as the boot main body in a direction of width of the boot main body.

16. The connector boot according to claim 11, wherein the push-down operation causes a movement of the lock tab toward the upper surface of the connector housing.

17. The connector boot according to claim 11, wherein the push-up operation causes a movement of the lock tab toward the upper surface of the connector housing.

18. The connector boot according to claim 11, further comprising:

a cable passageway for receiving a cable connected to the connector.

19. The connector boot according to claim 11, wherein the boot main body comprises a locking projection for locking with a connector recess formed in the connector housing.

20. The connector boot according to claim 11, wherein the boot main body comprises a pair of rear activator tabs located on substantially opposite sides of a cable connected to the connector.

* * * * *